United States Patent [19]

Wohlers

[11] 4,047,174

[45] Sept. 6, 1977

[54] METHOD OF REDUCING THE RADAR CROSS-SECTION OF A DIELECTRIC BODY

[75] Inventor: Robert J. Wohlers, Orchard Park, N.Y.

[73] Assignee: The United States of America as represented by the Secretary of the Army, Washington, D.C.

[21] Appl. No.: 736,935

[22] Filed: June 7, 1968

[51] Int. Cl.[2] ..... H01Q 15/18

[52] U.S. Cl. ..... 343/18 B; 102/105; 343/18 A

[58] Field of Search ..... 343/18 A, 18 B; 102/105

[56] References Cited

U.S. PATENT DOCUMENTS

| | | | |
|---|---|---|---|
| 2,436,578 | 2/1948 | Korn et al. | 343/18 B |
| 2,492,358 | 12/1949 | Clark | 343/18 B |
| 3,184,742 | 5/1965 | Cutler | 343/18 B |
| 3,230,531 | 1/1966 | Bischoft et al. | 343/18 B |
| 3,243,313 | 3/1966 | Aves, Jr. | 102/105 X |
| 3,413,636 | 11/1968 | Migdal | 343/18 B |

*Primary Examiner*—S. C. Buczinski

*Attorney, Agent, or Firm*—Nathan Edelberg; Robert P. Gibson; Aubrey J. Dunn

[57] ABSTRACT

An ablative coated missile nosecone or the like is coated with a thin resistive coating, and then with a thin conductive coating. The conductive coating may be laid down in a predetermined pattern. These coatings allow the nosecone to have a radar cross-section the same as a metal cone of the same size, rather than the larger radar cross-section presented by the dielectric ablative nosecone. Alternately, the dielectric may have a conductive material interspersed therein, such as graphite.

1 Claim, No Drawings

METHOD OF REDUCING THE RADAR CROSS-SECTION OF A DIELECTRIC BODY

BACKGROUND OF THE INVENTION

The usual nosecone for ballistic missiles is covered with an ablative material designed to ensure survival during reentry of the nosecone into the atmosphere. In general, the ablative coating is a dielectric material, and its presence on the surface of the metallic underbody of the cone presents an electrical structure that yields a radar cross-section larger than an all metallic counterpart. My invention effectively reduces this cross-section.

SUMMARY OF THE INVENTION

A missile nosecone or other dielectric body is coated with an electrically resistive material, and the resistive material is coated with a conductive material. The dielectric material may alternately have a conductive material dispersed therein. Either method reduces the radar cross-section of the body.

DESCRIPTION OF THE PREFERRED EMBODIMENTS

My invention may be readily accomplished by either of two different methods. The nosecone or other dielectric body may be coated with a thin layer of resistive material, such as carbon in a suitable vehicle. The layer of resistive material is then coated with a thin layer of a highly conductive material, such as silver or gold. The conductive material may be laid down in a pattern, such as isolated squares. Alternately, the ordinary nosecone covering may be replaced by a covering composed of a dielectric material with a conductive material interspersed within the dielectric. The conductive material may be highly conductive, as a powdered metal. A less conductive (resistive) material, such as carbon may be also used. Obviously the resistive or conductive coatings may be applied by various methods, such as spraying, dipping brushing, plating, etc. A mask may be used if a pattern is desired.

While specific embodiments of the invention have been disclosed, other embodiments may be obvious to one skilled in the area, in light of this disclosure. For example, the resistive coating may be a metal glaze, or a thin metal or metal alloy. Examples of the metal alloys which could be used are nickel-chromium and copper-nickel.

I claim:

1. A method of reducing the radar cross-section of a dielectric covered nosecone, including the steps of:

coating said nosecone with an electrically resistive material, and applying an electrically conductive material to said resistive coating in a predetermined pattern.

* * * * *